US009896815B2

(12) United States Patent
Ritvanen

(10) Patent No.: US 9,896,815 B2
(45) Date of Patent: Feb. 20, 2018

(54) METHOD AND APPARATUS FOR COLLECTING SURFACE LAYER OF LIQUID

(71) Applicant: S.T. RITVANEN OY, Raisio (FI)

(72) Inventor: Tapio Ritvanen, Raisio (FI)

(73) Assignee: S.T. RITVANEN OY, Raisio (FI)

( * ) Notice: Subject to any disclaimer, the term of this patent is extended or adjusted under 35 U.S.C. 154(b) by 0 days.

(21) Appl. No.: 14/893,981

(22) PCT Filed: May 28, 2014

(86) PCT No.: PCT/FI2014/050423
§ 371 (c)(1),
(2) Date: Nov. 25, 2015

(87) PCT Pub. No.: WO2014/191625
PCT Pub. Date: Dec. 4, 2014

(65) Prior Publication Data

US 2016/0122965 A1 May 5, 2016

(30) Foreign Application Priority Data

May 30, 2013 (FI) ..... 20135597

(51) Int. Cl.
*E02B 15/10* (2006.01)
*E02B 15/04* (2006.01)

(52) U.S. Cl.
CPC ..... *E02B 15/10* (2013.01); *E02B 15/048* (2013.01); *E02B 15/106* (2013.01); *E02B 15/108* (2013.01)

(58) Field of Classification Search
CPC ..... E02B 15/045; E02B 15/048; E02B 15/10; E02B 15/106; E02B 15/108
(Continued)

(56) References Cited

U.S. PATENT DOCUMENTS 3,565,254 A * 2/1971 Latimer ..... E02B 15/06 210/242.3
3,760,944 A 9/1973 Bell et al.
(Continued)

FOREIGN PATENT DOCUMENTS

DE 1 634 074 A1 2/1971
FR 2 424 368 A1 11/1979
(Continued)

OTHER PUBLICATIONS

Sep. 10, 2014 International Search Report issued in International Patent Application No. PCT/FI2014/050423.
(Continued)

*Primary Examiner* — Christopher Upton
(74) *Attorney, Agent, or Firm* — Oliff PLC

(57) ABSTRACT

A method for collecting a surface layer of a liquid into confined area, method including forming confined area by means of wall structure and moving some of surface layer of liquid into confined area by means of a flow of air directed into confined area through an opening made into wall structure of confined area so that amount of substance in surface layer of the liquid increases in confined area in comparison with surroundings. The bottom edge of opening made into wall structure of confined area is arranged to be below surface level of liquid outside confined area whereas its top edge is substantially above surface level of liquid outside confined area. The surface level of liquid inside confined area is arranged to be kept substantially on same level with surface level of liquid outside by providing a continuous liquid flow connection through lower portion of confined area into surroundings.

9 Claims, 3 Drawing Sheets

(58) Field of Classification Search
USPC ..... 210/747.6, 776, 170.05, 170.09, 170.11, 210/242.3, 923
See application file for complete search history.

(56) References Cited

U.S. PATENT DOCUMENTS

| | | | | | |
|---|---|---|---|---|---|
| 3,762,169 | A | * | 10/1973 | Graham | E02B 15/108 210/242.3 |
| 3,847,815 | A | | 11/1974 | Chastan-Bagnis | |
| 4,038,182 | A | * | 7/1977 | Jenkins | E02B 15/107 210/242.3 |
| 4,139,470 | A | | 2/1979 | Stagemeyer et al. | |
| 4,182,679 | A | * | 1/1980 | Van Hekle | E02B 15/048 210/242.3 |
| 4,221,669 | A | * | 9/1980 | Ravagnan | E02B 15/102 210/924 |
| 4,358,374 | A | * | 11/1982 | Morva | E02B 15/108 210/242.3 |
| 5,122,283 | A | * | 6/1992 | Wells | E02B 15/046 210/776 |
| 5,176,467 | A | * | 1/1993 | Baillie | E02B 15/108 405/62 |
| 2010/0270244 | A1 | | 10/2010 | Chao | |
| 2011/0259803 | A1 | | 10/2011 | Chao | |

FOREIGN PATENT DOCUMENTS

| | | | |
|---|---|---|---|
| GB | 1 408 451 | A | 10/1975 |
| JP | S56-76291 | A | 6/1981 |
| JP | H10-216038 | A | 8/1998 |
| KR | 970003586 | B1 | 3/1997 |

OTHER PUBLICATIONS

Sep. 10, 2014 Written Opinion issued in International Patent Application No. PCT/FI2014/050423.

* cited by examiner

METHOD AND APPARATUS FOR COLLECTING SURFACE LAYER OF LIQUID

The invention relates to a method for collecting a surface layer of a liquid into a confined area, the method comprising forming the confined area by means of a wall structure and moving some of the surface layer of the liquid into the confined area by means of a flow of air directed into the confined area through an opening made into the wall structure of the confined area so that the amount of substance in the surface layer of the liquid increases in the confined area in comparison with the surroundings, the opening formed to the wall structure of the confined area having its bottom edge below the surface level of the liquid outside the confined area and its top edge substantially above the surface level of the liquid outside the confined area and that the surface level of the liquid in the confined area is maintained substantially on a same level with the surface level of the liquid outside by providing a continuous liquid flow connection through the bottom part of the confined area into the surroundings. The invention also relates to an apparatus for collecting a surface layer of liquid into a confined area.

Differences in the specific weight of liquids and the lightness of different solids cause light pieces and liquid of a lower specific weight to rise upward in the basic liquid and spread in the surface layer of the liquid as an even layer. Examples that may be mentioned of such situations include oil spills and different kinds of light debris in different types of water bodies, such as harbour areas. Examples of light debris that may be mentioned include tree leaves, different kinds of packings, paper sheets, plastic waste, and the like, that may cause inconvenience and are often, especially in the case of different paper and plastic waste, aesthetically most unpleasant.

In oil combatting and collection of debris taking place in water bodies, a floating boom is typically used for restricting the spreading of the surface material to an increasingly thinner layer on a continuously widening area. The actual collection or removal of the surface material is carried out mainly in three ways, the principles of which are disclosed below.

The surface layer of the liquid is made to adhere to a solid surface and the solid surface is transferred to a collection site. The adhered material is removed from the surface at the collection site and the solid surface is returned to the affected location. These solutions employ e.g. brush skimmers, disc skimmers, rope skimmers or hose skimmers.

The liquid is pumped from below so intensively that a substantial amount of the surface layer is also carried with the basic liquid. In solutions of this type a conventional water pump sucks liquid through a nozzle that is under the surface. Another alternative is to use a catamaran-type surface vessel, in which case the centre channel of the vessel is blocked at the back, the propeller transmitting propulsion being at a sufficiently low level to take the vessel to the problem area without stirring the surface. This makes the removal of the slightly packed surface more efficient by an upward or downward suction.

Air is sucked intensively close to the surface of the liquid so that liquid and light pieces on the surface come along.

A typical feature of all the three methods disclosed above is high collection performance. A typical characteristic of the third, vacuum-cleaner-type alternative is a great need for power and, in addition, the collected materials become mixed, which makes the further processing of the collected material laborious. The efficiency of skimmers based on adhesion, in turn, is at its best in viscous liquids. High costs of purchase, use and servicing are typical of all of the above, which is why prior art solutions of this type are not properly suitable in minor incidents and in operations of a smaller scale.

Examples of solutions known in the field include solutions described in US patent publications 2010/0270244 A1 and 2011/0259803 A1. The solutions described in the above publications are meant for separating oil from liquid, for example. One of the reasons why the solutions in question are not suited to separating litter and other impurities appearing in pieces is that the air flow opening is a very narrow slit-like structure.

The object of the invention is to provide a method and an apparatus by which the prior-art disadvantages can be eliminated. This is achieved by the invention. The method of the invention is characterized by recirculating partly or totally the flow of air directed into the confined area through the opening into the confined area. The apparatus of the invention, in turn, is characterized in that in that the flow of air directed into the confined area is partly or totally re-circulated through the opening into the confined area.

An advantage of the invention, above all, is that it enables apparatuses affordable in terms of costs of purchase, use and servicing costs to be provided even in long-term and unmonitored use for maintenance of small-scale water bodies in particular. In this context, small-scale water bodies refer to e.g. harbour areas, small lakes, ponds, man-made basins, and the like. Another advantage of the invention is that it is simple and well suited for apparatuses of different sizes because the basic principle of the invention may well be applied also in large apparatuses although the above disclosure emphasizes small-scale operation.

The invention will be explained in the following in more detail by means of examples described in the attached drawing, in which FIG. 1 is a general view of an embodiment applying the method of the invention, FIG. 2 is a sectional view according to arrows II-II of FIG. 1;

Figure 1:
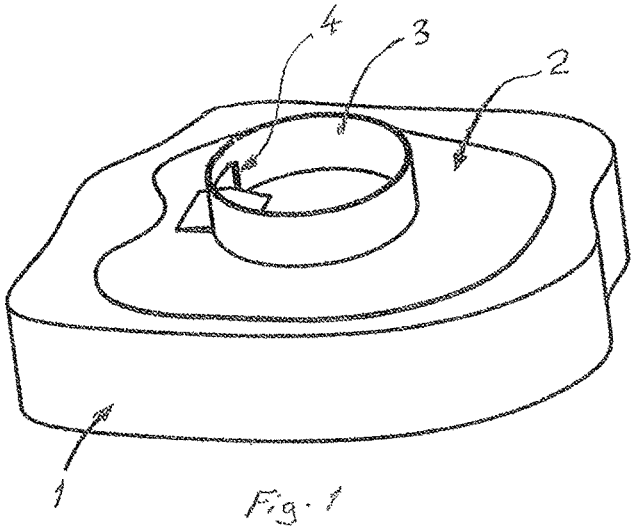

FIG. 1 is a general view of an embodiment applying the method of the invention. In FIG. 1 reference numeral 1 denotes a small part of a water area or water body with an oil spill 2 on the surface of it. In the area of the oil spill 2, there is a wall structure 3, i.e. a rim, defining a confined area into which the oil is to be collected. The wall structure 3 is provided with an opening 4 whose bottom edge is only slightly below the water surface and whose top edge, in turn, substantially above the water surface. This is shown clearly in FIG. 3. The wall structure 3 has been constructed so that there is a continuous liquid flow connection from the bottom part of the wall structure 3 into the surroundings. In the example of FIG. 1 this has been realized by forming a tubular wall structure, without a bottom element. However, it is also possible to form a structure where the wall structure is provided with a bottom through which liquid may flow. Examples that may be mentioned include a meshed structure or one with slits, or a similar filtering structure formed of a porous material, etc. The opening 4 is provided with width and height dimensions that allow not only the oil layer on the surface of the liquid but also e.g. leaves of trees, different packings, such as milk cartons, juice cans and other items that are often washed into water bodies, to pass through the opening 4 into the confined area.

Figure 2:
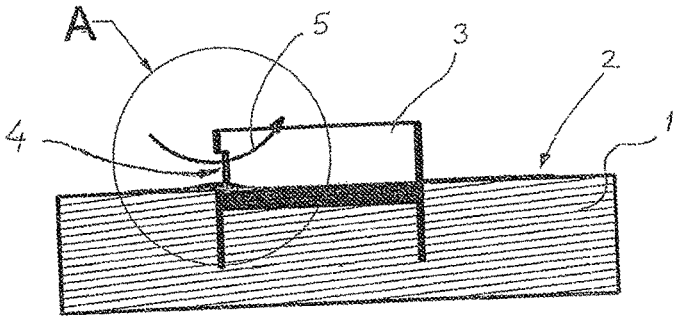
Figure 3:
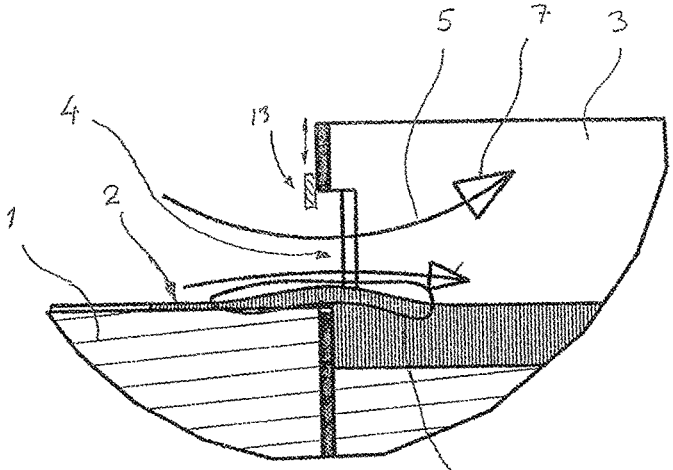
FIG. 3 shows area A of FIG. 2 on a larger scale.

FIGS. 2 and 3 illustrate the basic principle of the invention in greater detail. The method of the invention takes advantage of a characteristic of air flow according to which pressure drops as speed increases and the fact that as air moves friction tends to draw with it liquid at the interface between the air and a liquid surface bordering it from below. In FIGS. 2 and 3 reference numeral 5 denotes a route of a mechanically produced rapid flow of air through the opening 4 to the inside of the wall structure 1.

FIG. 3 shows point A of FIG. 2 in a larger scale. In FIG. 3 reference numeral 6 denotes a line that depicts an area influenced by the pressure-decreasing characteristic of the rapid flow of air 5. Arrow 7 shows the adhesion effect of the rapid flow of air 5 on the oil 2 due to friction. Inside the wall structure 3 the velocity of air decreases and the surface of the liquid is subjected to an atmospheric pressure almost equal to that on the outside, and, since the wall structure 3 has no impermeable bottom, the surfaces of the liquid are almost on the same level on the outside and the inside of the wall structure.

Figure 4:
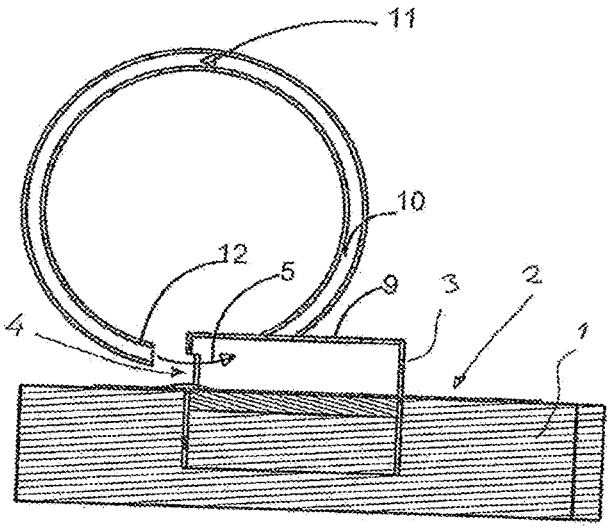
FIG. 4 is a schematic side view of an embodiment of the invention, which employs the principle of air circulation.

FIG. 4 is a schematic view of a preferred application for implementing the basic principle of the invention. The same reference numerals are used in FIG. 4 as in FIGS. 1 to 3 to refer to the corresponding parts.

FIG. 4 shows one way of producing the flow of air. In the application of FIG. 4 the flow of air fed by a blower 11 through the opening 11 into the confined area is recirculated by means of a channel structure 10 and a nozzle arrangement 12 forming a part of it and fed back into the confined area. The structure of the channel and the blower may be arranged as desired in connection with the apparatus. FIG. 4 shows the channel structure and the blower arranged in connection with a cover part 9 of the apparatus. It is obvious that the above mentioned circulation of air is not the only option but it is also possible to take air from the surroundings and convey it from the confined area back to the surroundings, etc. Likewise, it is obvious that air may be partly circulated and partly conveyed to the surroundings, etc.

Figure 5:
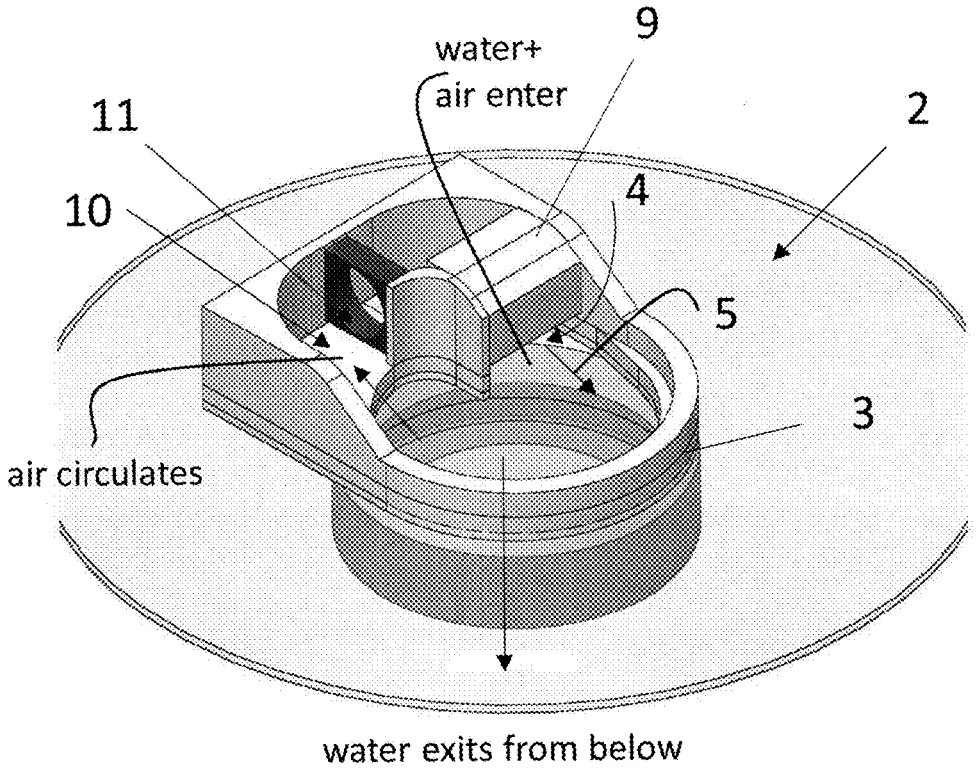
FIG. 5 is a schematic perspective view of a practical application of the invention, which employs the air circulation principle of FIG. 4.

FIG. 5 shows an implementation of the principle illustrated in FIG. 4. In FIG. 5, the same reference numerals as in FIG. 4 are used at corresponding points. FIG. 5 further shows circulation of air and water with arrows. In the embodiment of FIG. 5 the channel structure is formed by means of the wall structure 3 and the cover part 9 to provide a compact structure. By means of the embodiment of FIGS. 4 and 5 the kinetic energy of air needed for suction taking place inside the confined area is at least party recovered after the blower 11 and can be utilized. This improves the total efficiency of the apparatus and reduces external interference as regards noise and loud sound from blowing.

The operating principle of the apparatus of FIGS. 1 to 3 is described next. The apparatus is a floating structure by design. The apparatus is arranged on the surface of a liquid, such as water, as shown in FIG. 1, for example. Air flow, depicted with arrows in the examples shown in the figures, is achieved by a blower means arranged to the apparatus. Oil, or the like, on the surface of the liquid moves into the apparatus by the force of the air flow. The liquid flows back into the surroundings from below whereas oil, with other impurities, remains within the area defined by the wall structure and may be removed from there by a suitable means.

The method of the invention is suitable as a basic operating principle for an apparatus for purifying the water surface of a small pond, for example. Since leaves and dust gather onto the surface of small ponds typically from the outside while small amounts of resins, oils and waxes rise from the bottom due to organic activity, and since the surface of a garden pond is not subjected to strong winds, purification of the surface is extremely important. Even a small-sized blower is capable of moving leaves and thin layers of resin floating on the water surface into the area defined by the wall structure 3.

On the other hand, sizeable oil damages may occur at any time in harbours and marinas, and plastic bags, milk cartons, and similar packaging waste, is often floating in the vicinity of boats. A surface purification apparatus manufactured according to the method of the invention, with no collection devices that come into contact with the surface, is an ideal cleaning device and may be left floating without continuous monitoring. An axial blower of a few hundred watts is already capable of moving plastic bags and small boxes with sufficient efficiency into the area defined by the wall structure. In marine conditions a blow power with a blow capacity of some kilowatts or with a few dozen kilowatts in high seas enables even viscous oil to be collected into a thick layer on an area of a desired size.

Figure 6:
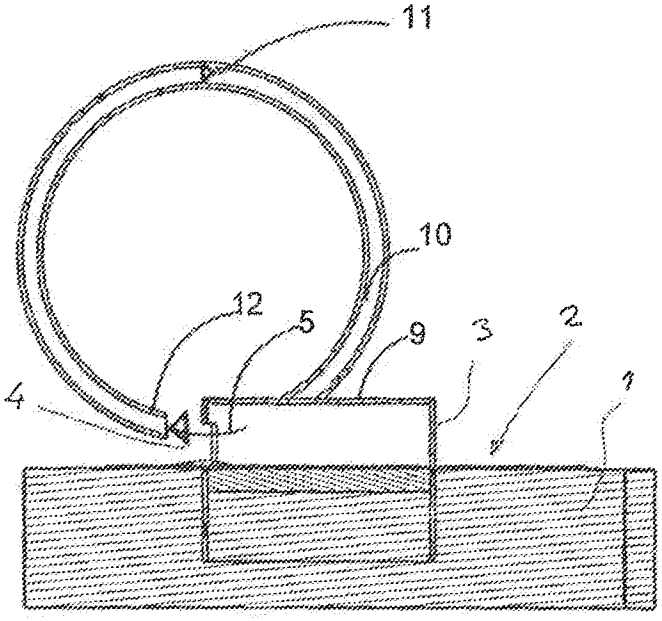
FIG. 6 is a schematic side view of an embodiment of the invention, which employs the principle of air circulation.

In the above, the invention is described by means of the application example of FIGS. 1 and 5. The invention is not limited in any way to said example, however, but it is obvious that other solutions are also possible. The examples mainly relate to water bodies. It is obvious that the method can also be applied to process waters of industry and to community development sites. For example, the blower may be positioned on either side of the opening, i.e. the blower may be arranged to blow air into the opening 4, or, correspondingly, to suck air from the environment through the opening 4 (see FIG. 6), etc. The opening 4 may be provided with suitable means 13 with which the size of the opening may be adjusted. The means in question may be arranged either on one or more edges of the opening. FIG. 3 is a general view of an embodiment of the means in question.

The invention may be freely modified within the scope of the attached claims.

The invention claimed is:

1. A method for collecting a surface layer of a liquid into a confined area, the method comprising forming the confined area by means of a wall structure, and moving some of the surface layer of the liquid into the confined area by means of a flow of air directed into the confined area through an opening made into the wall structure of the confined area so that the amount of substance in the surface layer of the liquid increases in the confined area in comparison with the surroundings, the opening formed to the wall structure of the confined area having its bottom edge below the surface level of the liquid outside the confined area and its top edge substantially above the surface level of the liquid outside the confined area, the surface level of the liquid in the confined area is maintained substantially on a same level with the surface level of the liquid outside by providing a continuous liquid flow connection through the bottom part of the confined area into the surroundings, and wherein re-circulating partly or totally the flow of air directed into the confined area through the opening into the confined area by means of a channel structure.

2. A method as claimed in claim 1, wherein implementing the wall structure forming the confined area as a structure without a bottom.

3. A method as claimed in claim 1, wherein implementing the wall structure forming the confined area as a structure with a bottom part permeable to water.

4. An apparatus for collecting a surface layer of a liquid into a confined area, the apparatus comprising a confined area formed by means of a wall structure, the wall structure being provided with an opening, and means for creating a flow of air through the opening into the confined area for moving the surface layer of the liquid from the surroundings through the opening into the confined area so that the amount of the substance in the surface layer of the liquid increases in the confined area in comparison with the surrounding area, the opening formed to the wall structure of the confined area having a bottom edge that is arranged to be below the surface level of the liquid outside the confined area and a top edge substantially above the surface level of the liquid outside the confined area, the surface level of the liquid in the confined area is arranged to be maintained substantially on a same level with the surface level of the liquid outside by providing a continuous liquid flow connection through the bottom part of the confined area into the surroundings, and wherein the flow of air directed into the confined area is partly or totally re-circulated through the opening into the confined area by means of a channel structure.

5. An apparatus as claimed in claim 4, wherein the wall structure forming the confined area is implemented as a structure without a bottom.

6. An apparatus as claimed in claim 4, wherein the wall structure forming the confined area is implemented as a structure with a bottom permeable to water.

7. An apparatus as claimed in claim 4, wherein the means for creating the flow of air through the opening into the confined area comprise a blower that is arranged to blow air through the opening into the confined area.

8. An apparatus as claimed in claim 4, wherein the means for creating the flow of air through the opening into the confined area comprise a blower that is arranged to suck air through the opening into the confined area.

9. An apparatus as claimed in claim 4, wherein the opening is provided with means for adjusting the size of the opening.

* * * * *